US007553099B2

(12) United States Patent
Bandou et al.

(10) Patent No.: US 7,553,099 B2
(45) Date of Patent: Jun. 30, 2009

(54) IMAGE FORMING APPARATUS

(75) Inventors: Takayoshi Bandou, Anan (JP); Yoshihiko Imura, Daito (JP)

(73) Assignee: Funai Electric Co., Ltd., Daito-shi (JP)

( * ) Notice: Subject to any disclaimer, the term of this patent is extended or adjusted under 35 U.S.C. 154(b) by 638 days.

(21) Appl. No.: 11/391,478

(22) Filed: Mar. 29, 2006

(65) Prior Publication Data

US 2006/0222436 A1 Oct. 5, 2006

(30) Foreign Application Priority Data

Apr. 1, 2005 (JP) ..... 2005-106677

(51) Int. Cl.
*B41J 11/58* (2006.01)

(52) U.S. Cl. ..... 400/624; 400/692; 271/9.09; 271/145; 271/162; 271/213

(58) Field of Classification Search ..... 400/624, 400/625, 691, 692, 693; 399/391, 392, 393; 271/9.09, 145, 162, 164, 207, 213
See application file for complete search history.

(56) References Cited

U.S. PATENT DOCUMENTS

| | | | | |
|---|---|---|---|---|
| 4,974,033 | A * | 11/1990 | Yamada et al. | 399/124 |
| 6,215,970 | B1 * | 4/2001 | Yoshikawa et al. | 399/124 |
| 7,142,805 | B2 * | 11/2006 | Mizuno et al. | 399/392 |
| 7,306,217 | B2 * | 12/2007 | Bandou et al. | 271/145 |
| 7,322,763 | B2 * | 1/2008 | Yang | 400/624 |
| 2004/0012141 | A1 * | 1/2004 | Hara et al. | 271/145 |
| 2005/0220519 | A1 * | 10/2005 | Mizuno et al. | 399/392 |
| 2005/0225025 | A1 * | 10/2005 | Chikumoto | 271/162 |
| 2006/0263127 | A1 * | 11/2006 | Kim et al. | 399/393 |

FOREIGN PATENT DOCUMENTS

| | | | |
|---|---|---|---|
| JP | 07-309454 | A | 11/1995 |
| JP | 08-198480 | A | 8/1996 |
| JP | 09-295718 | A | 11/1997 |
| JP | 2000-128367 | A | 5/2000 |
| JP | 2002-068535 | A | 3/2002 |
| JP | 2002-347997 | A | 12/2002 |
| JP | 2003-118854 | A | 4/2003 |
| JP | 2007279273 | A * | 10/2007 |

* cited by examiner

*Primary Examiner*—Ren Yan
(74) *Attorney, Agent, or Firm*—Crowell & Moring LLP

(57) ABSTRACT

An image forming apparatus comprises a paper feed tray that can be opened and closed with respect to the apparatus body and a cover tray that can double as a manual feed tray. The paper feed tray has first side walls and first protrusions formed on the inner surfaces of the first side walls. The cover tray has: connection portions that are configured to be detachably connected to pivot shafts provided at the apparatus body and that are connected to the pivot shafts so as to rotate about the pivot shafts; second side walls; and second protrusions formed on the outer surfaces of the second side walls. The cover tray serves as a cover for covering sheets of paper stacked on the paper feed tray when it is in a position where the second protrusions are located below the first protrusions. The cover tray serves as a manual feed tray when it is in a position where the second protrusions are placed on the first protrusions so that the cover tray is inclined with one end adjacent to the pivot shafts located lower than the other end.

4 Claims, 8 Drawing Sheets

IMAGE FORMING APPARATUS

BACKGROUND OF THE INVENTION

1. Field of the Invention

The present invention relates to image forming apparatus such as printers, copiers, facsimiles, and the like.

2. Description of the Related Art

There are known image forming apparatus such as printers comprising a paper feed tray that is attached to the apparatus body so as to be freely opened and closed with respect to the apparatus body and that, in use, is opened to a horizontal position for holding a stack of paper thereon (see, for example, Japanese laid-open patent publication Nos. 2002-347997, Hei 7-309454, Hei 8-198480, and 2003-118854). Such an apparatus is designed so that the paper feed tray is kept closed when the apparatus is not in use, and it is opened for holding paper sheets when the apparatus is used, thereby saving space.

Image forming apparatus are also known that comprise a cover tray to be set for covering paper sheets stacked on a paper feed tray so as to prevent dust and dirt from sticking to printed sides of the paper sheets (see, for example, Japanese laid-open patent publication Nos. Hei 9-295718, 2000-128367, and 2002-68535).

The above described conventional image forming apparatus comprising a paper feed tray that can be opened and closed with respect to the apparatus body have the following problem. As shown in FIG. 14, when carrying such an apparatus 101, a user Y may insert his/her one hand H under a paper feed tray 102 to lift the apparatus 101. The paper feed tray 102 is held on the apparatus body 110 via, for example, pivot shafts 121 and bearings 122 while the apparatus 101 is not lifted, i.e., placed on a surface, as shown in FIG. 15A. However, when the user Y grasps the paper feed tray 102 and lifts up the apparatus 101 from the position as shown in FIG. 14, the load G of the apparatus 101 is exerted on the pivot shafts 121 of the paper feed tray 102. Accordingly, as shown in FIG. 15B, a force acts on the paper feed tray 102 to bend inward the portions of the tray where the pivot shafts 121 are provided, which may cause the pivot shafts 121 to get off the bearings 122 and thus cause the paper feed tray 102 to be detached from the apparatus body 110.

Japanese laid-open patent publication No. 2002-68535 discloses an image forming apparatus designed so that its cover tray (cover portion) serves as a manual feed tray. However, there is no known image forming apparatus that comprises an openable and closable paper feed tray and a cover tray doubling as a manual feed tray, wherein the cover tray does not obstruct opening and closing of the paper feed tray and the cover tray can be easily set for manual feed printing.

SUMMARY OF THE INVENTION

An object of the present invention is to provide an image forming apparatus comprising an openable and closable paper feed tray that can keep the paper feed tray properly attached to the apparatus body even when a user grasps the paper feed tray to lift up the apparatus.

Another object of the present invention is to provide an image forming apparatus that comprises an openable and closable paper feed tray and a cover tray doubling as a manual feed tray, wherein the cover tray does not obstruct opening and closing of the paper feed tray and the cover tray can be easily set for manual feed printing.

According to an aspect of the present invention, an image forming apparatus comprises: a paper feed tray that is attached to an apparatus body of the image forming apparatus so as to be freely opened and closed with respect to the apparatus body and that is opened to a position for holding a sheet of paper thereon when the image forming apparatus is used; and a cover tray that is set to cover the sheet of paper placed on the paper feed tray when the paper feed tray is in the open position.

The paper feed tray includes: a plate portion on which the sheet of paper is placed; a pair of left and right first side walls extending upward from two sides of the plate portion to be substantially perpendicular to the plate portion; a pair of left and right supported portions that are formed on outer surfaces of the first side walls and are rotatably supported on the apparatus body by first pivot shafts extending in a substantially horizontal direction substantially perpendicular to a paper feed direction; and a pair of left and right first protrusions formed on inner surfaces of the first side walls.

The cover tray includes: a cover plate portion that is positioned over the sheet of paper placed on the plate portion of the paper feed tray; a pair of left and right second side walls that extends downward from two sides of the cover plate portion to be substantially perpendicular to the cover plate portion and that are positioned inside the first side walls to be substantially parallel to the first side walls; connection portions that are configured to be detachably connected to second pivot shafts provided at the apparatus body and that are connected to the second pivot shafts in a manner that can rotate about the second pivot shafts, the second pivot shafts extending in the substantially horizontal direction substantially perpendicular to the paper feed direction; and a pair of left and right second protrusions formed on outer surfaces of the second side walls so that a distance between each of the second protrusions and each of the second pivot shafts is substantially equal to a distance between each of the first protrusions and each of the second pivot shafts when the connection portions are connected to the second pivot shafts.

The cover tray serves as a manual feed tray, which is used with a sheet of paper for manual feeding placed on a top surface of the cover plate portion, when the cover tray is in an inclined position where the connection portions are connected to the second pivot shafts and the second protrusions are placed on the first protrusions so that one end of the cover tray adjacent to the second pivot shafts is located lower than the other end.

When a downward force is applied to the cover tray in the position where the second protrusions are placed on the first protrusions, the second protrusions push the first protrusions outward so that the first side walls are pushed outward while the second side walls are pushed inward, and then the second protrusions are pressed into a space between the first protrusions so as to move below the first protrusions. The cover tray serves as a cover for covering the sheet of paper placed on the paper feed tray when the cover tray is in the position where the second protrusions are located below the first protrusions.

With the above configuration, the cover tray serves as the cover for covering paper sheets placed on the paper feed tray in the position where the second protrusions of the cover tray are located below the first protrusions of the paper feed tray with the connection portions connected to the second pivot shafts of the apparatus body. Further, the cover tray serves as the manual feed tray in the inclined position where the second protrusions of the cover tray are placed on the first protrusions of the paper feed tray so that the end of the cover tray adjacent to the second pivot shafts is located lower than the other end. More particularly, the cover tray can double as the manual feed tray.

When a downward force is applied to the cover tray in the position where the second protrusions are placed on the first protrusions with the connection portions connected to the second pivot shafts at the apparatus body, the second protrusions are pressed into the space between the first protrusions so as to move to the position below the first protrusions, making use of bending of the paper feed tray and the cover tray. Accordingly, by applying a downward force to the cover tray, a user can easily change the position of the cover tray from the position for use as the manual feed tray to the position for use as the cover.

Moreover, the cover tray is configured so that the connection portions thereof are detachably connected to the second pivot shafts provided at the apparatus body. Accordingly, when the paper feed tray is closed, the cover tray can be detached so as not to obstruct opening/closing of the paper feed tray.

Preferably, each of the second protrusions has a substantially trapezoidal cross-section with a lower base on each of the second side walls, wherein each of the second protrusions has: an upper base portion formed so that height from a corresponding one of the second side walls is greater than a horizontal distance between each of the second side walls and each of the first protrusions when the connection portions are connected to the second pivot shafts; a first inclined surface formed so that height from the corresponding second side wall increases from a lower end to an upper end of the first inclined surface, wherein when the second protrusion is moved downward to contact a corresponding one of the first protrusions, the first inclined surface comes in contact with the first protrusion before the upper base portion contacts the first protrusion; and a second inclined surface formed so that height from the corresponding second side wall increases from an upper end to a lower end of the second inclined surface, wherein when the second protrusion is moved upward to contact the corresponding first protrusion, the second inclined surface comes in contact with the first protrusion before the upper base portion contacts the first protrusion. When a downward force is applied to the cover tray in the position where the second protrusions are placed on the first protrusions, the first inclined surfaces push the first protrusions outward so that the first side walls are pushed outward while the second side walls are pushed inward, and then the second protrusions are pressed into the space between the first protrusions along the first inclined surfaces so as to move below the first protrusions. When an upward force is applied to the cover tray in the position where the second protrusions are located below the first protrusions, the second inclined surfaces push the first protrusions outward so that the first side walls are pushed outward while the second side walls are pushed inward, and then the second protrusions are pressed into the space between the first protrusions along the second inclined surfaces so as to move above the first protrusions.

With this configuration, each of the second protrusions has the first inclined surface formed so that its height from the corresponding second side wall increases from the lower end to the upper end, so that when the second protrusions are pressed downward into the space between the first protrusions, they gradually move along the first inclined surfaces. Accordingly, the second protrusions can be smoothly moved downward from the position above the first protrusions.

Further, each of the second protrusions has the second inclined surface formed so that its height from the corresponding second side wall increases from the upper end to the lower end, so that when the second protrusions are pressed upward into the space between the first protrusions, they gradually move along the second inclined surfaces. Accordingly, the second protrusions can be smoothly moved upward from the position below the first protrusions.

Preferably, the image forming apparatus further comprises a paper pressing plate to press the sheet of paper placed on the paper feed tray against a transport mechanism located above the paper pressing plate. The paper pressing plate has a pair of left and right notches formed by partially cutting side portions of the paper pressing plate so that, when the paper feed tray is in the closed position, the first protrusions are at least partially received in the notches and side faces of the paper pressing plate face the first protrusions in a manner that are almost in contact with the first protrusions. When a force acts on the paper feed tray in the closed position to bend inward the first side walls of the paper feed tray, the first protrusions are pressed against the portions of the paper pressing plate where the notches are formed so as to stop the inward bending of the first side walls.

With the above configuration, when the force acts on the paper feed tray in the closed position to bend inward the first side walls of the paper feed tray, the first protrusions of the paper feed tray come in contact with the portions of the paper pressing plate where the notches are formed, so that the inward bending of the first side walls can be stopped. This can prevent the supported portions formed on the outer surfaces of the first side walls from being displaced by a large amount from their normal positions, thus preventing the paper feed tray from becoming detached from the apparatus body.

While the novel features of the present invention are set forth in the appended claims, the present invention will be better understood from the following detailed description taken in conjunction with the drawings.

BRIEF DESCRIPTION OF THE DRAWINGS

The present invention will be described hereinafter with reference to the annexed drawings. It is to be noted that all the drawings are shown for the purpose of illustrating the technical concept of the present invention or embodiments thereof, wherein.

DESCRIPTION OF THE PREFERRED EMBODIMENTS

Referring now to the accompanying drawings, a preferred embodiment of the present invention is described. It is to be noted that the following description of preferred embodiment of the present invention has been presented for purposes of illustration and description, and is not intended to be exhaustive or to limit the present invention to the precise form disclosed.

Figure 1:
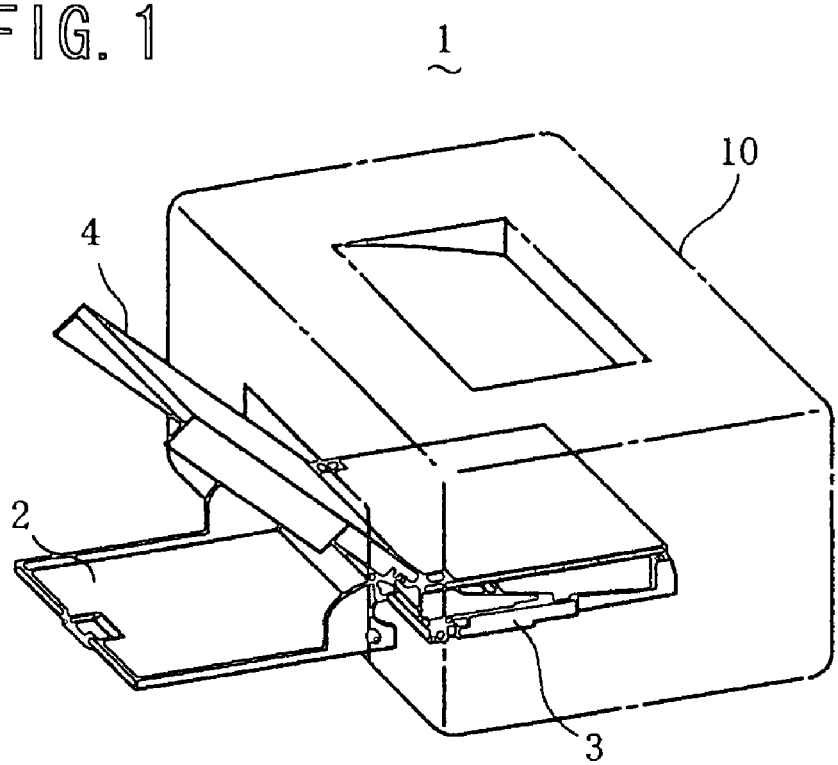
FIG. 1 is a perspective view showing a printer according to one embodiment of the present invention, with a paper feed tray in the open position.
Figure 2:
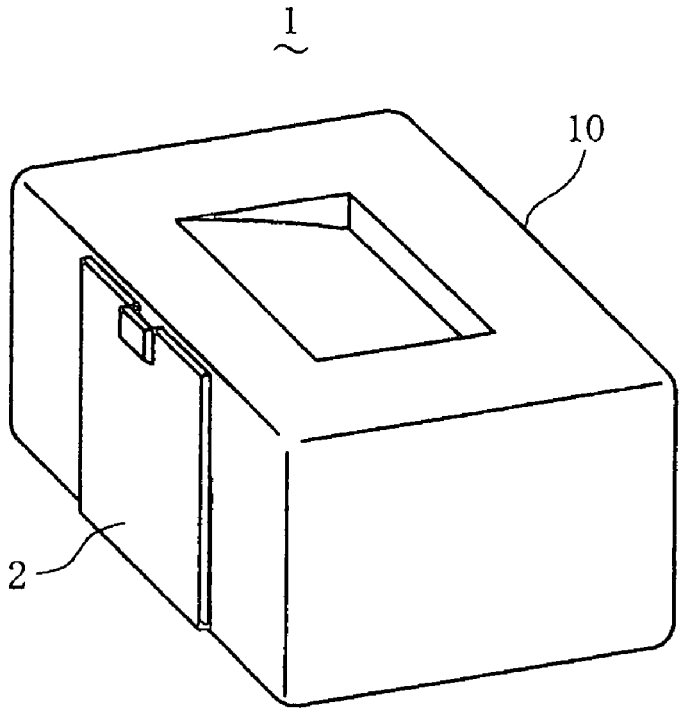
FIG. 2 is a perspective view of the printer with the paper feed tray in the closed position.

FIG. 1 shows a printer 1 according to one embodiment of the present invention. The printer 1 is an apparatus that prints an image on a sheet of paper or the like based on image data (which may contain text data) input via a device such as a personal computer connected thereto. As shown in FIG. 1, the printer 1 comprises a paper feed tray 2 that is attached to the printer body 10 so as to be freely opened and closed with respect to the printer body 10 and that, in use, is opened to a substantially horizontal position for holding a stack of paper thereon; a paper pressing plate 3 that presses a paper sheet placed on the paper feed tray 2 against a transport mechanism such as a feed roller located above the paper pressing plate; and a cover tray 4 that is set for covering the paper sheets stacked on the paper feed tray 2 when the paper feed tray 2 is in the open position. As shown in FIG. 2, when the printer 1 is not in use, the paper feed tray 2 can be kept closed for saving space.

Figure 3:
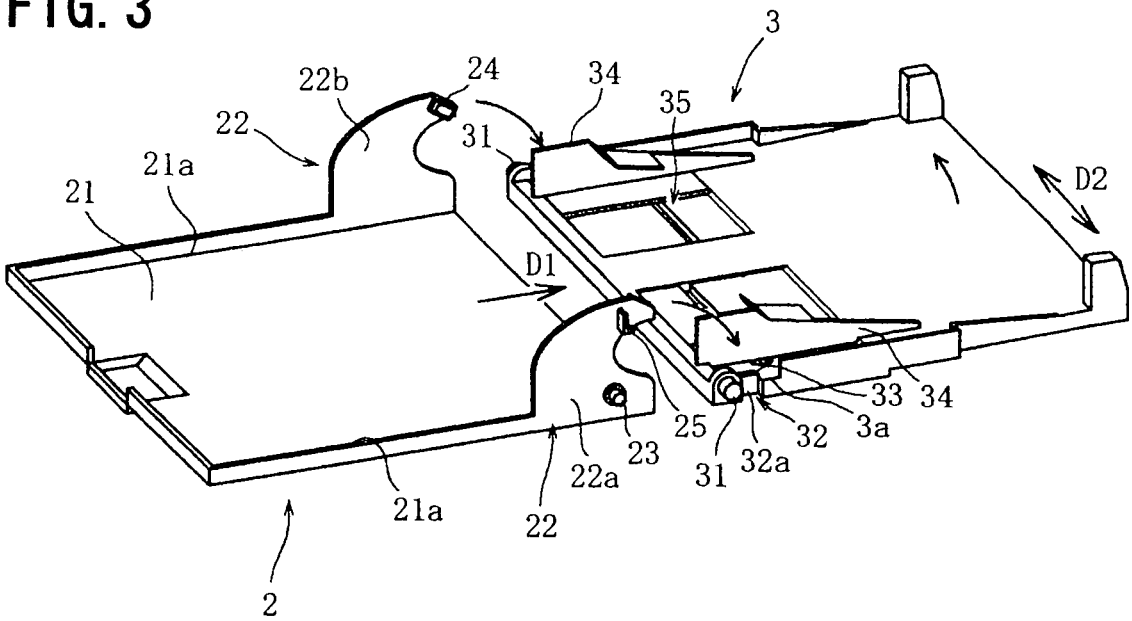
FIG. 3 is a perspective view of the paper feed tray and a paper pressing plate of the printer.
Figure 4:
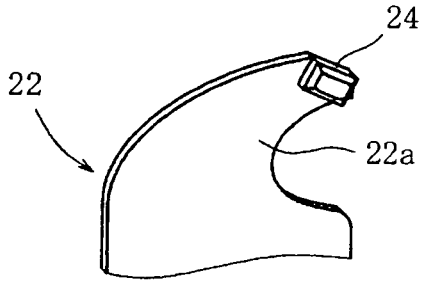
FIG. 4 is a perspective view of part of the paper feed tray where a first protrusion is formed.

As shown in FIG. 3 and FIG. 4, the paper feed tray 2 has a plate portion 21 on which a paper sheet is placed; a pair of left and right first side walls 22 extending upward from the both sides 21*a* of the plate portion 21 to be substantially perpendicular to the plate portion 21; and a pair of left and right supported portions 23 that are formed on the outer surfaces 22*a* of the first side walls 22 to be rotatably supported on the printer body 10 by first pivot shafts extending in a substantially horizontal direction D2 (hereinafter, referred to simply as "direction D2") substantially perpendicular to a paper feed direction D1. In this embodiment, the supported portions 23 serve as the first pivot shafts and the printer body 10 is provided with bearings for the shafts. Alternatively, the printer body can be provided with the first pivot shafts, with supported portions provided as the bearings.

The paper feed tray 2 further has a pair of left and right first protrusions 24 protruding from the inner surfaces 22*b* of the first side walls 22. Formed on the outer surfaces 22*a* of the first side walls 22 are guide protrusions 25 to guide the opening/closing of the paper feed tray 2 along with guide grooves formed in the printer body 10.

Figure 5:
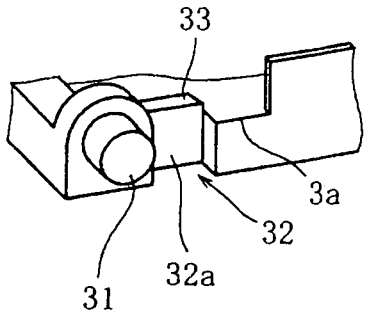
FIG. 5 is a perspective view of part of the paper pressing plate where a notch is formed.

As shown in FIG. 3 and FIG. 5, the paper pressing plate 3 has: a pair of left and right pivot shafts 31 extending in the direction D2; a pair of left and right notches 32 formed by partially cutting the side portions 3*a* of the paper pressing plate 3; and a paper guide 34 for guiding a paper sheet placed on the paper feed tray 2 in accordance with the size of the paper sheet. The paper pressing plate 3 rotates about the pivot shafts 31 to press the placed paper sheet against the transport mechanism thereabove. The paper guide 34 is mounted on the paper pressing plate 3 in a manner that can slide in the direction D2 through a groove 35 that is formed in the paper pressing plate 3 to extend in the direction D2.

The notches 32 are formed so that, when the paper feed tray 2 is in the closed position, the first protrusions 24 are at least partially received in the notches and the side faces 32*a* of the paper pressing plate 3 face the first protrusions 24 in a manner that are almost in contact with the first protrusions 24. At the portion of the paper pressing plate 3 where each of the notches 32 is formed, there is formed a step 33, so that the portion 32*a* of the side face where the notch 32 is formed is somewhat wider than other portions. By forming the portion 32*a* of the side face where each of the notches 32 is formed to be wider than other portions, each of the first protrusions 24 can more reliably contact the notch 32 portion.

Figure 6:
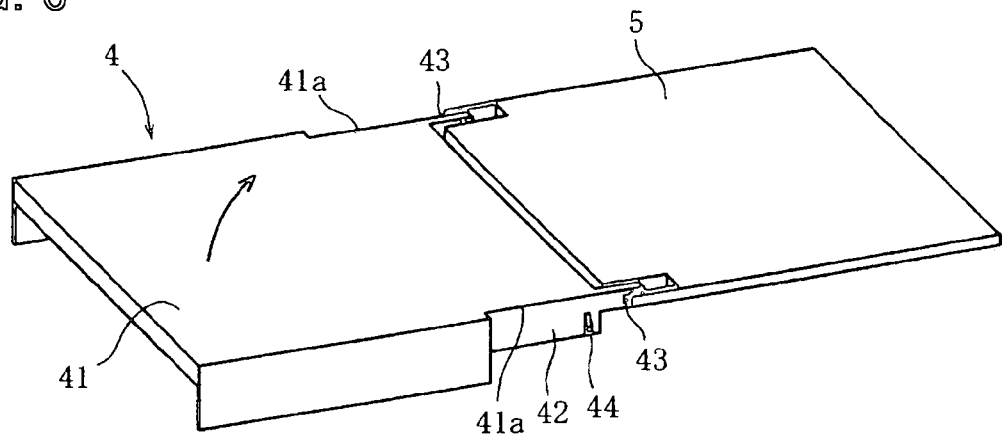
FIG. 6 is a perspective view of a cover tray and a MPF plate of the printer.
Figure 7:
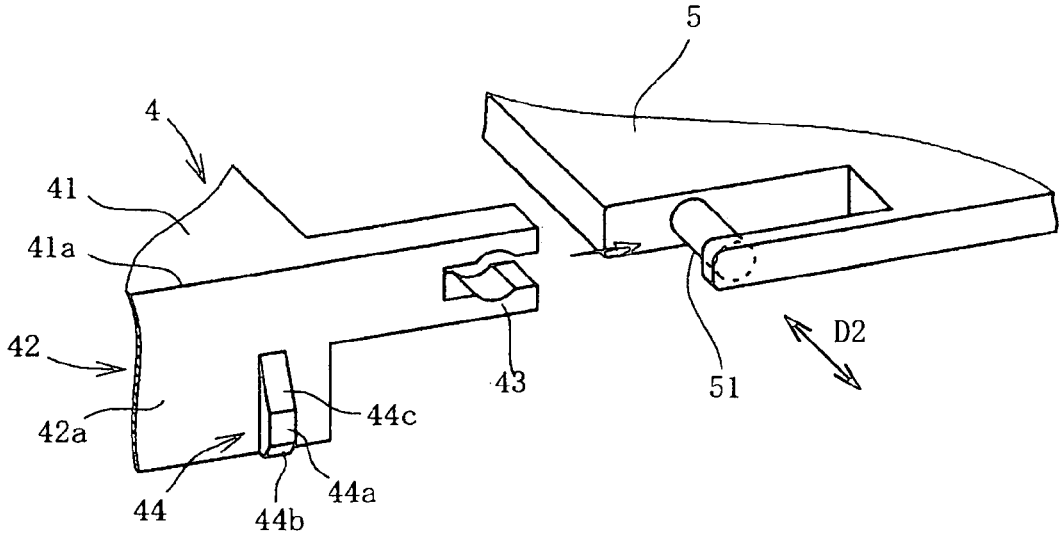
FIG. 7 is a perspective view showing part of the cover tray where a connection portion is formed and part of the MPF plate where a second pivot shaft is formed.

As shown in FIG. 6 and FIG. 7, the cover tray 4 has: a cover plate portion 41 that is positioned over sheets of paper stacked on the plate portion 21 of the paper feed tray 2; and a pair of left and right second side walls 42 that extend downward from the both sides 41*a* of the cover plate portion 41 to be substantially perpendicular to the cover plate portion 41 and that are positioned inside the first side walls 22 of the paper feed tray to be substantially parallel to the first side walls 22.

The cover tray 4 further has: connection portions 43 that are configured to be detachably connected to second pivot shafts 51, which are provided on a manual paper feeder (MPF) plate 5 disposed in the printer body 10 and extend in the direction D2, and that are connected to the second pivot shafts 51 in a manner that can rotate about the second pivot shafts 51; and a pair of left and right second protrusions 44 formed on the outer surfaces 42*a* of the second side walls 42. It is to be noted that the MPF plate 5 is a member for pressing a sheet of paper placed on the cover tray 4 against the transport mechanism thereabove.

Figure 8:
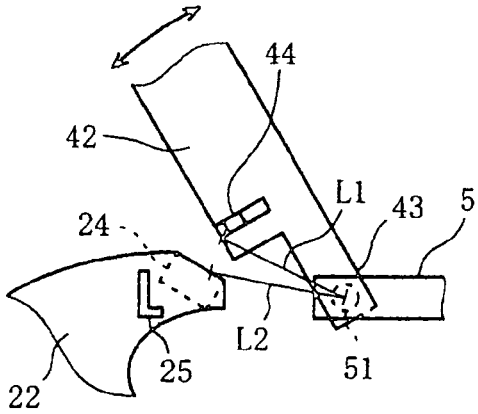
FIG. 8 is a side view showing the relative position between the first protrusion of the paper feed tray and the second protrusion of the cover tray.

As shown in FIG. 8, each of the second protrusions 44 is formed on the second side wall 42 so that, when the connection portion 43 is connected to the second pivot shaft 51, a distance L1 from the second pivot shaft 51 is substantially equal to a distance L2 between the first protrusion 24 and the second pivot shaft 51.

Figure 9:
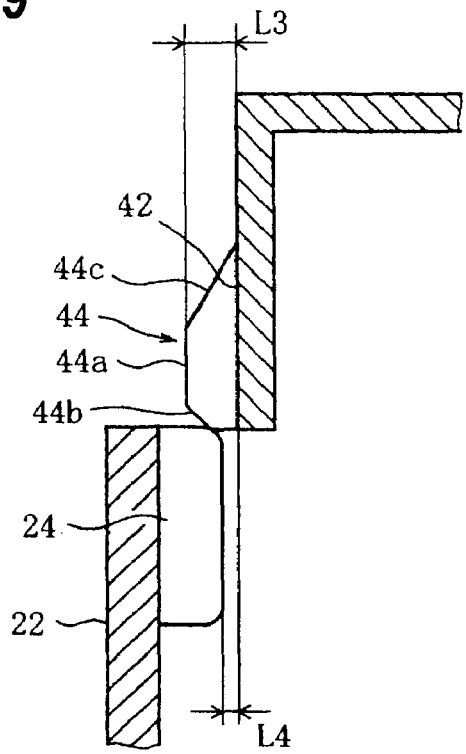
FIG. 9 is a cross sectional view as viewed from the front, showing the relative position between the first protrusion of the paper feed tray and the second protrusion of the cover tray.

As shown in FIG. 9, each of the second protrusions 44 is formed so that the vertical section thereof is substantially trapezoidal with a lower base on the second side wall 42. Further, each of the second protrusions 44 has an upper base portion 44*a*, a first inclined surface 44*b*, and a second inclined surface 44*c*. The upper base portion 44*a* is formed so that its height L3 from the second side wall 42 is greater than a horizontal distance L4 between the second side wall 42 and the first protrusion 24 when the connection portions 43 are connected to the second pivot shafts 51. The first inclined surface 44*b* is formed so that its height from the second side wall 42 increases from the lower end to the upper end. When the second protrusion 44 is moved downward to contact the first protrusion 24, the first inclined surface 44*b* comes in contact with the first protrusion 24 before the upper base portion 44*a* contacts the first protrusion 24. The second inclined surface 44*c* is formed so that its height from the second side wall 42 increases from the upper end to the lower end. When the second protrusion 44 is moved upward to contact the first protrusion 24, the second inclined surface 44*c* comes in contact with the first protrusion 24 before the upper base portion 44*a* contacts the first protrusion 24.

Figure 10:
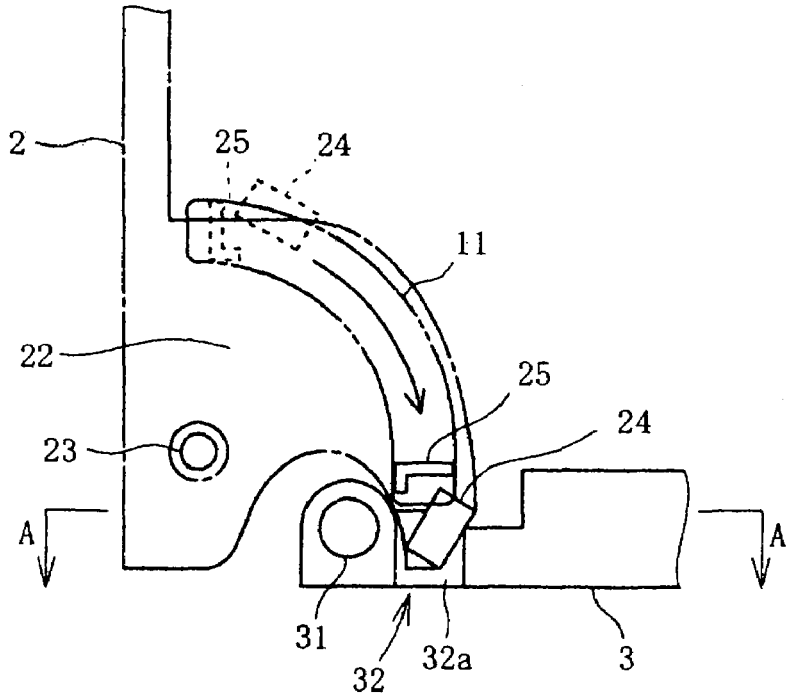
FIG. 10 is a side view showing the relative position between the first protrusion of the paper feed tray and the notch of the paper pressing plate.

Referring now to FIG. 10, the relative position between the first protrusion 24 of the paper feed tray 2 and the notch 32 of the paper pressing plate 3 is described in detail, with the paper feed tray 2 in the open or closed position. In FIG. 10, the first protrusion 24 and the guide protrusion 25 in the position where the paper feed tray 2 is open are shown by the dashed lines, the first protrusion 24 and the guide protrusion 25 in the position where the paper feed tray 2 is closed are shown by the solid lines, and the other portions of the paper feed tray 2 are shown by the chain lines. The guide groove 11 formed in the printer body 10 is shown by the chain double-dashed line.

As shown in FIG. 10, the paper feed tray 2 is rotated about the supported portions 23 while being guided by the guide protrusions 25 and the guide grooves 11, so that the first protrusions 24 are partially received in the notches 32 when the paper feed tray 2 comes to the closed position.

Figure 11:
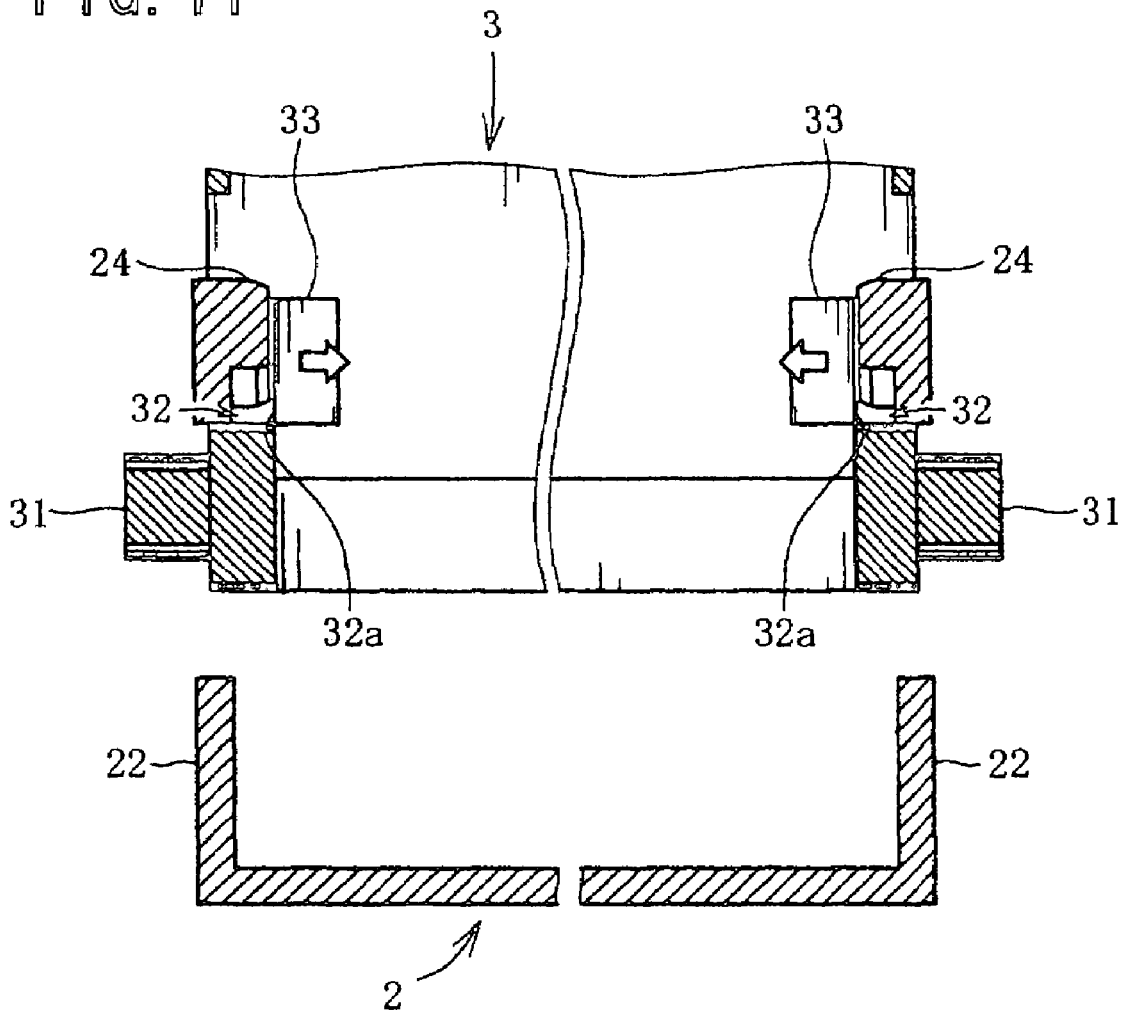
FIG. 11 is a cross sectional view taken along a line A-A in FIG. 10.

Referring now to FIG. 11, the relative position between the first protrusion 24 of the paper feed tray 2 and the notch 32 of the paper pressing plate 3 is described in detail, where a force acts on the paper feed tray 2 in the closed position to bend inward the first side walls 22 of the paper feed tray 2. It is to be noted that the paper guide 34 and the groove 35 for mounting of the paper guide 34 are not shown in FIG. 11 for simplicity. As described above, the first protrusions 24 of the paper feed tray 2 are arranged so that, when the paper feed tray 2 is in the closed position, they are partially received in the notches 32 to face the side faces 32*a* of the paper pressing plate 3 in a manner that are almost in contact with the side faces 32*a*. When a force F acts on the paper feed tray 2 in this position to bend inward the first side walls 22 of the paper feed tray 2, the first protrusions 24 are pressed against the portions where the notches 32 are formed (more particularly, the first protrusions 24 are pressed against the portions 32*a* of the side faces of the paper pressing plate 3 where the notches 32 are formed). As a result, inward bending of the first side walls 22 can be stopped.

As described above, according to the printer 1 of this embodiment, when a force acts on the paper feed tray 2 in the closed position to bend inward the first side walls 22 of the paper feed tray 2, the first protrusions 24 formed on the inner surfaces 22*b* of the first side walls 22 are pressed against the portions of the paper pressing plate 3 where the notches 32 are formed so that the inward bending of the first side walls 22 can be stopped. This can prevent the supported portions 23 formed on the outer surfaces 22*a* of the first side walls 22 from being displaced by a large amount from their normal positions, thus preventing the paper feed tray 2 from becoming detached from the printer body 10.

Figure 12A:
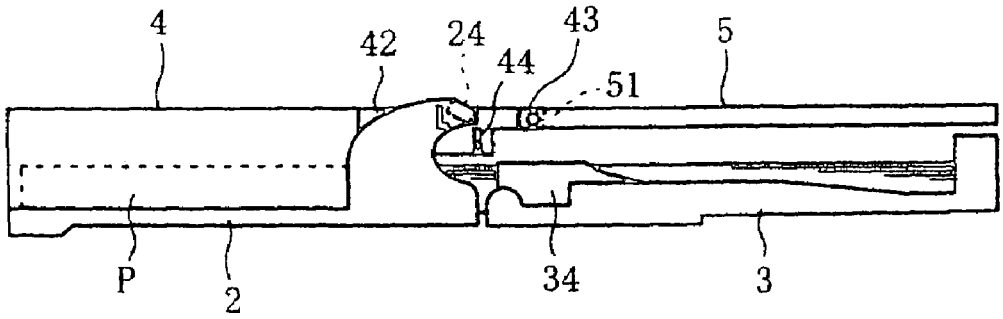
FIG. 12A is a side view showing the cover tray in the position for use as a cover.
Figure 12B:
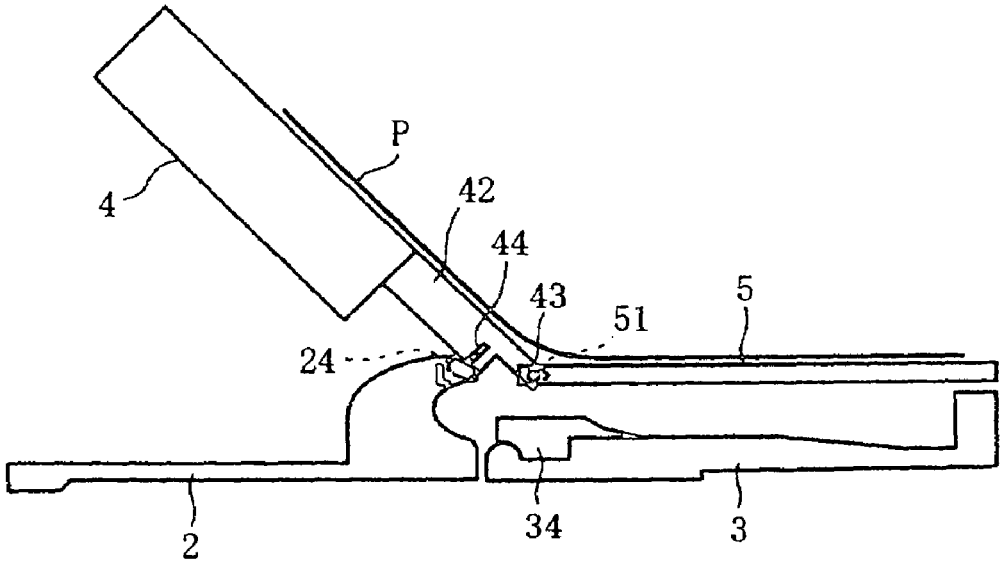
FIG. 12B is a side view showing the cover tray in the position for use as a manual feed tray.

Referring now to FIGS. 12A and 12B, the relative position between the first protrusion 24 of the paper feed tray 2 and the second protrusion 44 of the cover tray 4 is described in each of the cases where the cover tray 4 is used as a cover for covering a stack of paper on the paper feed tray 2 and where the cover tray 4 is used as a manual feed tray. The cover tray 4 is attached to the MPF plate 5 by inserting the connection portions 43 onto the second pivot shafts 51 of the MPF plate 5 when the paper feed tray 2 is in the open position. As shown in FIG. 12A, when the cover tray 4 is used as the cover for covering the stack of paper P on the paper feed tray 2, it is set so that their second protrusions 44 are located below the first protrusions 24 of the paper feed tray 2. Using the cover tray 4 in this way can prevent dust and dirt from sticking to printed sides of the sheets of paper P.

As shown in FIG. 12B, when the cover tray 4 is used as the manual feed tray, their second protrusions 44 are placed on the first protrusions 24 of the paper feed tray 2 with the connection portions 43 connected to the second pivot shafts 51 of the MPF plate 5 so that the cover tray 4 is inclined with its end adjacent to the second pivot shafts 51 located lower than the other end. A sheet of paper P for manual feeding is placed on the top surface of the cover plate portion 41 of the cover tray 4.

Holding the cover tray 4 with the second protrusions 44 placed on the first protrusions 24 is useful not only when the cover tray 4 is used as the manual feed tray but also when it is not in use as the manual feed tray. For example, when adjusting the paper guide 34 of the paper pressing plate 3, a user does not need to hold the cover tray 4 with one hand. Accordingly, position adjustment of the paper guide 34 can be easily achieved with the cover tray 4 lifted.

Referring now to FIGS. 13A to 13D, it is described how the positions of the paper feed tray 2 and the cover tray 4 change when a downward force is applied to the cover tray 4 with the second protrusions 44 placed on the first protrusions 24, and when an upward force is applied to the cover tray 4 with the second protrusions 44 located below the first protrusions 24.

Figure 13A:
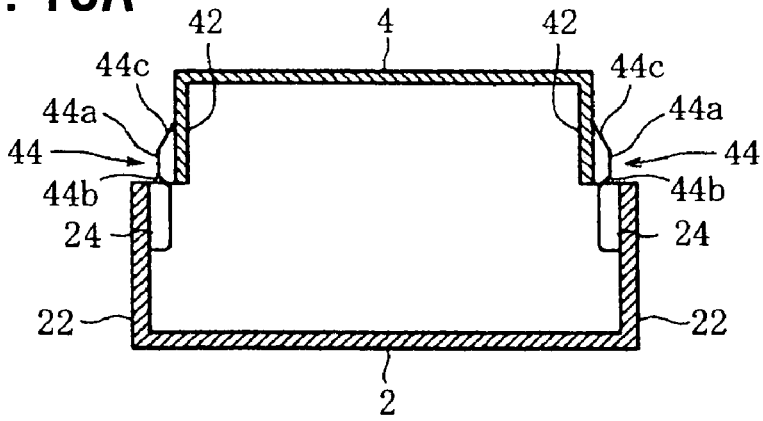
FIGS. 13A to 13D are cross sectional views of the paper feed tray and the cover tray as viewed from the front, showing the second protrusions of the cover tray placed on the first protrusions of the paper feed tray, the second protrusions downward pressed into the space between the first protrusions, the second protrusions located below the first protrusions, and the second protrusions upward pressed into the space between the first protrusions, respectively.
Figure 13B:
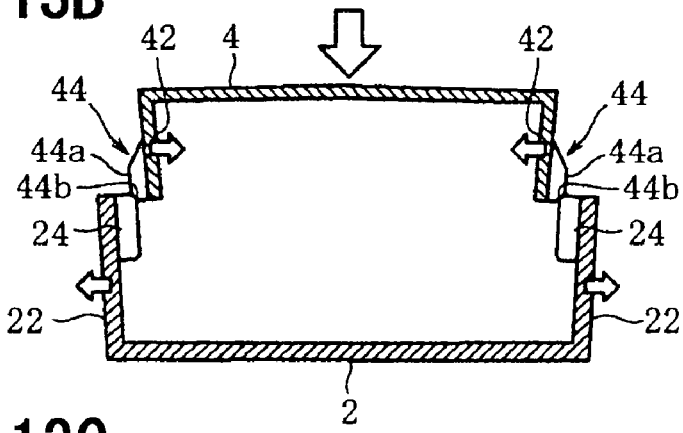

When a downward force is applied to the cover tray 4 in the position where the second protrusions 44 are placed on the first protrusions 24 as shown in FIG. 13A, the first inclined surfaces 44*b* push the first protrusions 24 outward so that the first side walls 22 are pushed outward while the second side walls 42 are pushed inward (as shown in FIG. 13B). Then, the second protrusions 44 are pressed into the space between the first protrusions 24 along the first inclined surfaces 44*b* so as to move below the first protrusions 24 (as shown in FIG. 13C).

Figure 13C:
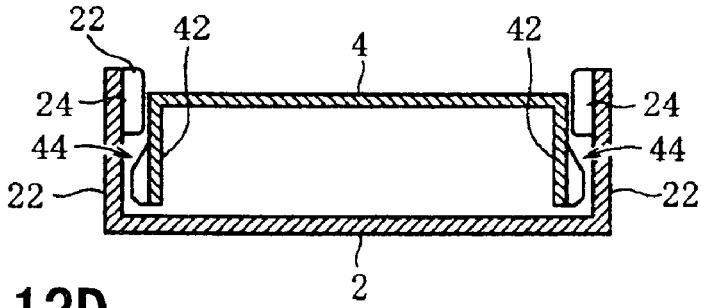
Figure 13D:
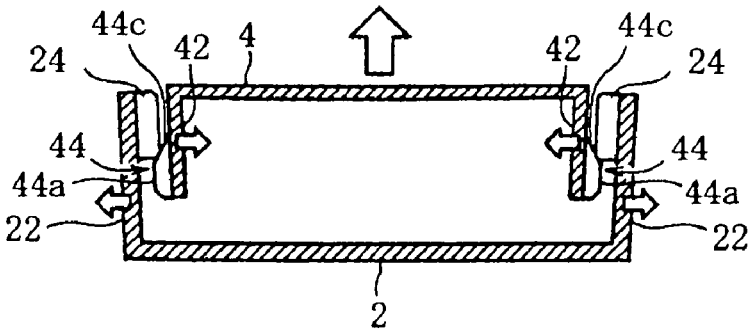
Figure 14:
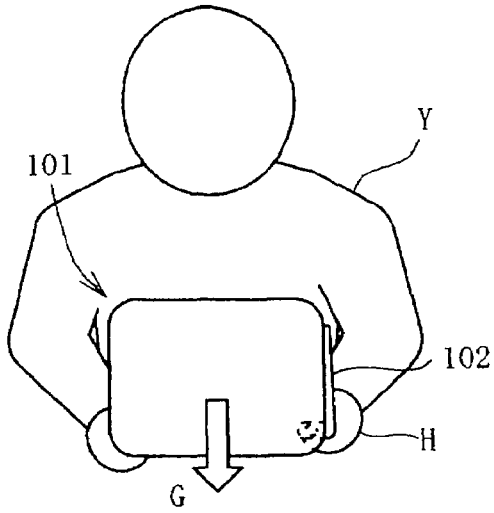
FIG. 14 PRIOR ART
FIG. 14 illustrates a user lifting a conventional printer while grasping its paper feed tray.
Figure 15A:
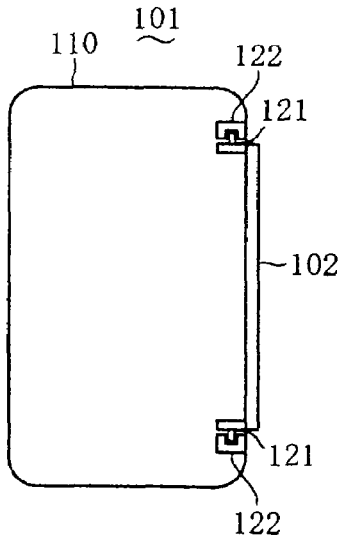
FIG. 15A PRIOR ART
FIG. 15A is a top view showing the paper feed tray of the conventional printer before the printer is lifted up.
Figure 15B:
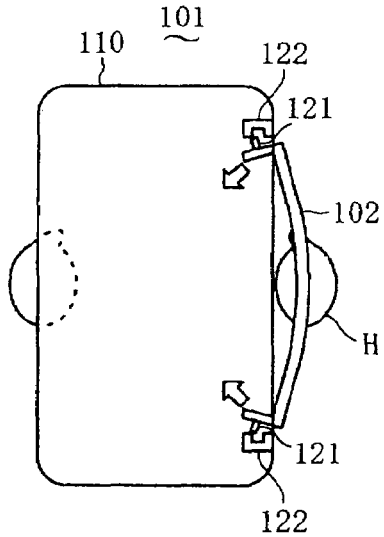
FIG. 15B PRIOR ART
FIG. 15B is a top view showing the paper feed tray of the conventional printer when the printer is lifted with the paper feed tray grasped by the user.

On the other hand, when an upward force is applied to the cover tray 4 in the position where the second protrusions 44 are located below the first protrusions 24 as shown in FIG. 13C, the second inclined surfaces 44*c* push the first protrusions 24 outward so that the first side walls 22 are pushed outward while the second side walls 42 are pushed inward (as shown in FIG. 13D). Then, the second protrusions 44 are pressed into the space between the first protrusions 24 along the second inclined surfaces 44*c* so as to move above the first protrusions 24.

As described above, according to the printer 1 of this embodiment, the cover tray 4 serves as the cover for covering paper sheets placed on the paper feed tray 2 in the position where the second protrusions 44 of the cover tray 4 are located below the first protrusions 24 of the paper feed tray 2 with the connection portions 43 connected to the second pivot shafts 51 of the MPF plate 5. Further, the cover tray 4 serves as the manual feed tray in the inclined position where the second protrusions 44 of the cover tray 4 are placed on the first protrusions 24 of the paper feed tray 2 so that the end of the cover tray 4 adjacent to the second pivot shafts 51 is located lower than the other end. More particularly, the cover tray 4 can double as the manual feed tray.

When a downward force is applied to the cover tray 4 in the position where the second protrusions 44 of the cover tray 4 are placed on the first protrusions 24 of the paper feed tray 2 with the connection portions 43 of the cover tray 4 connected to the second pivot shafts 51 of the MPF plate 5, the second protrusions 44 of the cover tray 4 are pressed into the space between the first protrusions 24 of the paper feed tray 2 so as to move to the position below the first protrusions 24, making use of bending of the paper feed tray 2 and the cover tray 4.

Accordingly, by applying a downward force to the cover tray 4, a user can easily change the position of the cover tray 4 from the position for use as the manual feed tray to the position for use as the cover.

Each of the second protrusions 44 has the first inclined surface 44*b* formed so that its height from the corresponding second side wall 42 increases from the lower end to the upper end. With this configuration, when the second protrusions 44 are pressed downward into the space between the first protrusions 24, they gradually move along the first inclined surfaces 44*b*. Accordingly, the second protrusions 44 can be smoothly moved downward from the position above the first protrusions 24.

The cover tray 4 is configured so that the connection portions 43 thereof are detachably connected to the second pivot shafts 51 of the MPF plate 5 as described above. Accordingly, when the paper feed tray 2 is closed, the cover tray 4 can be detached so as not to obstruct opening/closing of the paper feed tray 2.

The present invention has been described above using a presently preferred embodiment, but those skilled in the art will appreciate that various modifications are possible. Accordingly, all such modifications are intended to be included within the spirit and scope of the present invention.

This application is based on Japanese patent application 2005-106677 filed Apr. 1, 2005, the contents of which are hereby incorporated by reference.

What is claimed is:

1. An image forming apparatus comprising:

a paper feed tray that is attached to an apparatus body of the image forming apparatus so as to be freely opened and closed with respect to the apparatus body and that is opened to a position for holding a sheet of paper thereon when the image forming apparatus is used; and a cover tray that is set to cover the sheet of paper placed on the paper feed tray when the paper feed tray is in the open position, wherein the paper feed tray includes:

a plate portion on which the sheet of paper is placed;

a pair of left and right first side walls extending upward from two sides of the plate portion to be substantially perpendicular to the plate portion;

a pair of left and right supported portions that are formed on outer surfaces of the first side walls and are rotatably supported on the apparatus body by first pivot shafts extending in a substantially horizontal direction substantially perpendicular to a paper feed direction; and a pair of left and right first protrusions formed on inner surfaces of the first side walls, wherein the cover tray includes:

a cover plate portion that is positioned over the sheet of paper placed on the plate portion of the paper feed tray;

a pair of left and right second side walls that extends downward from two sides of the cover plate portion to be substantially perpendicular to the cover plate portion and that are positioned inside the first side walls to be substantially parallel to the first side walls;

connection portions that are configured to be detachably connected to second pivot shafts provided at the apparatus body and that are connected to the second pivot shafts in a manner that can rotate about the second pivot shafts, the second pivot shafts extending in the substantially horizontal direction substantially perpendicular to the paper feed direction; and a pair of left and right second protrusions formed on outer surfaces of the second side walls so that a distance between each of the second protrusions and each of the second pivot shafts is substantially equal to a distance between each of the first protrusions and each of the second pivot shafts when the connection portions are connected to the second pivot shafts, wherein the cover tray serves as a manual feed tray, which is used with a sheet of paper for manual feeding placed on a top surface of the cover plate portion, when the cover tray is in an inclined position where the connection portions are connected to the second pivot shafts and the second protrusions are placed on the first protrusions so that one end of the cover tray adjacent to the second pivot shafts is located lower than the other end, wherein, when a downward force is applied to the cover tray in the position where the second protrusions are placed on the first protrusions, the second protrusions push the first protrusions outward so that the first side walls are pushed outward while the second side walls are pushed inward, and then the second protrusions are pressed into a space between the first protrusions so as to move below the first protrusions, wherein the cover tray serves as a cover for covering the sheet of paper placed on the paper feed tray when the cover tray is in the position where the second protrusions are located below the first protrusions.

2. The image forming apparatus according to claim 1, wherein each of the second protrusions has a substantially trapezoidal cross-section with a lower base on each of the second side walls, wherein each of the second protrusions has:

an upper base portion formed so that height from a corresponding one of the second side walls is greater than a horizontal distance between each of the second side walls and each of the first protrusions when the connection portions are connected to the second pivot shafts;

a first inclined surface formed so that height from the corresponding second side wall increases from a lower end to an upper end of the first inclined surface, wherein when the second protrusion is moved downward to contact a corresponding one of the first protrusions, the first inclined surface comes in contact with the first protrusion before the upper base portion contacts the first protrusion; and a second inclined surface formed so that height from the corresponding second side wall increases from an upper end to a lower end of the second inclined surface, wherein when the second protrusion is moved upward to contact the corresponding first protrusion, the second inclined surface comes in contact with the first protrusion before the upper base portion contacts the first protrusion, wherein when a downward force is applied to the cover tray in the position where the second protrusions are placed on the first protrusions, the first inclined surfaces push the first protrusions outward so that the first side walls are pushed outward while the second side walls are pushed inward, and then the second protrusions are pressed into the space between the first protrusions along the first inclined surfaces so as to move below the first protrusions, and wherein when an upward force is applied to the cover tray in the position where the second protrusions are located below the first protrusions, the second inclined surfaces push the first protrusions outward so that the first side walls are pushed outward while the second side walls are pushed inward, and then the second protrusions are pressed into the space between the first protrusions along the second inclined surfaces so as to move above the first protrusions.

3. The image forming apparatus according to claim 1, further comprising a paper pressing plate to press the sheet of paper placed on the paper feed tray against a transport mechanism located above the paper pressing plate, wherein the paper pressing plate has a pair of left and right notches formed by partially cutting side portions of the paper pressing plate so that, when the paper feed tray is in the closed position, the first protrusions are at least partially received in the notches and side faces of the paper pressing plate face the first protrusions in a manner that are almost in contact with the first protrusions, wherein, when a force acts on the paper feed tray in the closed position to bend inward the first side walls of the paper feed tray, the first protrusions are pressed against the portions of the paper pressing plate where the notches are formed so as to stop the inward bending of the first side walls.

4. The image forming apparatus according to claim 3, wherein the paper pressing plate has a paper guide for guiding the sheet of paper placed on the paper feed tray in accordance with size of the sheet of paper.

* * * * *